US005191676A

United States Patent [19]

Gerner

[11] Patent Number: 5,191,676

[45] Date of Patent: Mar. 9, 1993

[54] SPLIT HEMISPHERE FOOT WITH COOPERATING SNAP-OVER RETAINING LIPS

[75] Inventor: James L. Gerner, Shawnee, Kans.

[73] Assignee: Fixtures Manufacturing Corporation, Kansas City, Mo.

[21] Appl. No.: 808,102

[22] Filed: Dec. 13, 1991

[51] Int. Cl.[5] ..... A47B 91/06

[52] U.S. Cl. ..... 16/42 T; 16/42 R

[58] Field of Search ..... 16/42 R, 42 T

[56] References Cited

U.S. PATENT DOCUMENTS 2,644,978 7/1953 Becker ..... 16/42 T

FOREIGN PATENT DOCUMENTS 2436586 5/1980 France ..... 16/42 T

OTHER PUBLICATIONS

Drawing Cover-44000 Glide dated May 16, 1989.

Drawing Glide-44000 Ball dated May 17, 1989.

*Primary Examiner*—W. Donald Bray

*Attorney, Agent, or Firm*—Litman, McMahon & Brown

[57] ABSTRACT

A spherical glide securable to a structural leg comprising a first substantially hemispherical half and a second substantially hemispherical half secured together by cooperating interference means on the first half and the second half and further including means for securing the spherical glide to the leg. The cooperating interference means may comprise a circumferential wall extending from a frist half and receivable by re-entrant fit within a recess in the second half.

17 Claims, 1 Drawing Sheet

Fig.1.
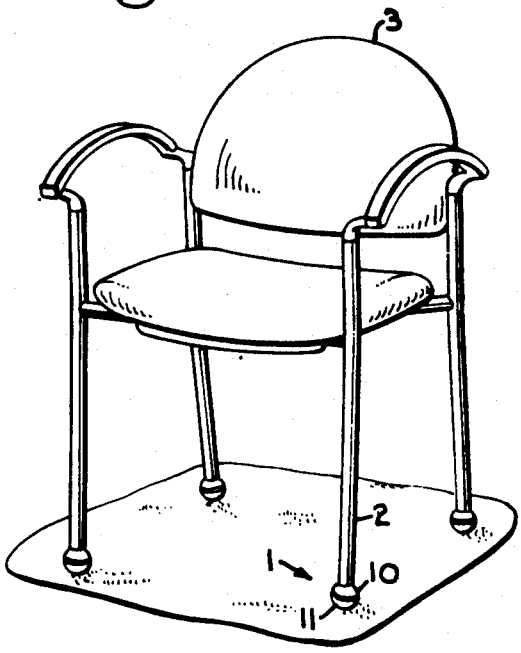
Fig.2.
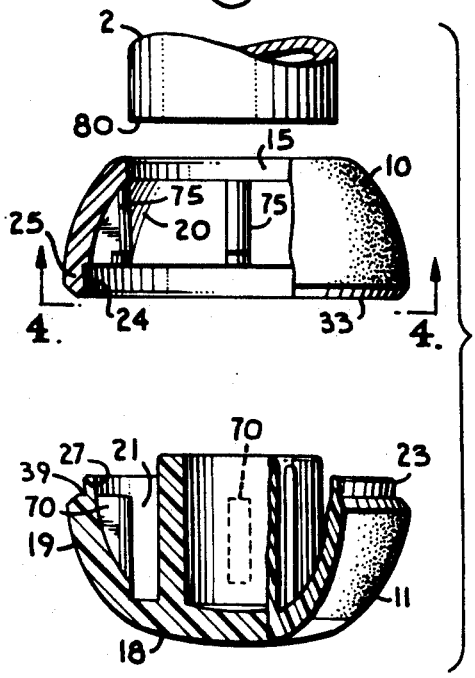
Fig.3.
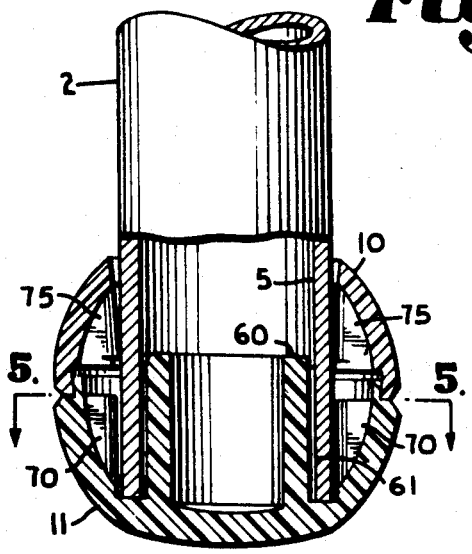
Fig.5.
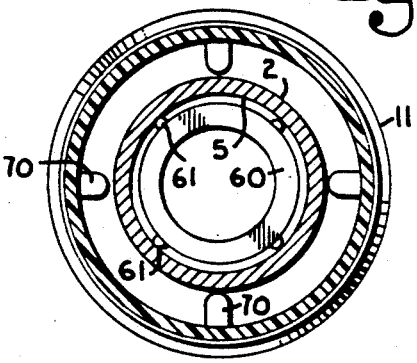
Fig.4.
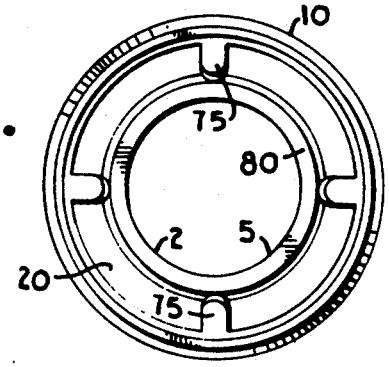
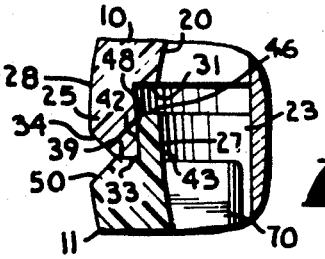
Fig.6.

SPLIT HEMISPHERE FOOT WITH COOPERATING SNAP-OVER RETAINING LIPS

BACKGROUND OF THE INVENTION

The present invention relates to caps, glides or feet attachable to structural legs or posts and, in particular, to a split hemispherical foot with cooperating snap-over retaining lips securable to furniture legs. Feet or glides have been secured to furniture legs to increase the surface area contact between the furniture and the floor and to reduce the amount of friction between the furniture and the floor. Spherical glides having a flattened lower surface and made of hard durable plastic have been developed to fit over the ends of furniture legs. These spherical glides increase the surface area contact between the furniture and the floor and the hard durable plastic of the glide provides a low friction surface for contact with the floor.

Such spherical glides are preferably made in two pieces or halves because the two-piece construction results in an economical design that is easy to manufacture and assemble. Various techniques have been used to join individual halves to form a spherical glide. Glue has been used to join the halves but such a practice has been generally unsatisfactory. The gluing process is time-consuming, messy and results in an unsatisfactory looking product. When the halves are put together, glue is forced between seams and often hardens on the outer surface of the glide causing unacceptable appearance.

Attempts have been made to fasten the halves forming a glide by sonic welding. However, the resultant welds often lack the necessary strength to hold the two halves together and the welding process often results in an unsatisfactorily appearing product.

SUMMARY OF THE INVENTION

The present invention comprises a foot or glide attachable to a structural leg such as the leg of a piece of furniture wherein the glide is formed from a first half and a second half. The first half and the second half are secured together by cooperating interference means on the first half and the second half. The glide further comprises a means for securing the glide to a leg of a piece of furniture.

The glide may comprise an upper half and a lower half wherein the upper half includes a leg receiving aperture extending therethrough and the upper half and the lower half are substantially hollow. The means for securing the glide to a leg of a piece of furniture may comprise a nipple extending upward from a lower portion of the lower half. The nipple is adapted to be insertable within the hollow interior or cavity of a furniture leg formed from hollow tubing. Elongate bosses on the nipple are adapted to engage the inner surface of the tubing forming the leg creating an interference fit when the nipple is inserted into the interior of the tubing forming the leg. This interference fit secures the glide to a leg of a piece of furniture.

The glide may be spherical wherein the upper half is a hollow frusto-hemispherical half and the lower half is a hollow flattened hemispherical half. The outer surface of the spherical glide is generally rounded without sharp edges. The cooperating interference means may comprise a circular wall integrally formed with and extending away from or beyond an interfacial surface of either the lower half or the upper half of the spherical glide and a recess formed in the half that does not include the circumferential wall. The circumferential wall is snappingly or reentrantly receivable within the recess to secure the upper half to the lower half of the glide.

OBJECTS AND ADVANTAGES OF THE INVENTION

Therefore, the objects of the present invention are: to provide a foot or glide adapted to be secured to a structural leg and comprising a first half and a second half wherein the halves include cooperating interference means for securing the halves together; to provide such a glide wherein one of the halves includes a peripheral or circular wall adapted to be snappingly or reentrantly secured within a recess in the other half to secure the halves together; to provide such a glide wherein the circular wall generally is not visible when the first half and the second half are secured together; to provide such a glide wherein it is a simple procedure to rapidly secure the first half to the second half; to provide such a glide wherein it is difficult to separate the first half from the second half once they are secured together; to provide such a glide which is securely attachable to a leg of a piece of furniture; to provide such a glide having a generally spherical shape; to provide such a glide having a flattened lower surface for providing increased surface area contact between the leg and a floor upon which the furniture is supported; to provide such a glide made of a relatively low friction material; to provide such a glide which is relatively easy and inexpensive to manufacture and particularly well adapted for its intended use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view showing glides in accordance with the present invention secured to legs of a chair.

FIG. 2 is an enlarged, fragmentary and exploded view of a glide in accordance with the present invention secured to a leg of a chair as shown in FIG. 1 with portions broken away to show detail thereof.

FIG. 3 is an enlarged and fragmentary view of a glide secured to a leg of the chair, the glide being in section to show interior details.

FIG. 4 is a cross-sectional view taken along line 4—4 of FIG. 2.

FIG. 5 is a cross-sectional view taken along line 5—5 of FIG. 3.

FIG. 6 is an enlarged and fragmentary view of the glide as shown in FIG. 3 with portions broken away to show means for securing an upper half of the glide to a lower half of the glide.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral I represents a substantially spherical foot or glide in accordance with the present invention attached to a leg 2 of a chair 3. The glide 1 is particularly adapted for attachment to a leg 2 constructed of hollow metal tubing having a cylindrical cavity 5 extending therethrough. However, it is foreseen that the glide 1 may be adapted for use and attachment to legs of various shapes and materials of construction and to legs of various types of furniture such as tables, desks, sofas, and beds. It is also foreseen that the glide 1 may be adapted to be attached to other structural legs such as the legs of dishwashers or refrigerators and in particular such structural legs constructed of hollow metal tubing.

The glide 1 comprises a first or upper half 10 and a second or lower half 11. The upper half 10 is hollow and frusto-hemispherical having a leg receiving aperture 15 extending through an upper portion of the upper half 10. The diameter of the leg receiving aperture 15 is preferably slightly greater than the outer diameter of the leg 2 to which the glide 1 is to be attached. The lower half 11 is hollow and generally hemispherical except that a lower portion 18 of the lower half 11 has a greater radius of curvature than an upper portion 19 of the lower half 11. The lower portion 18 of the lower half 11 is generally flattened with respect to the upper portion 19. The upper half 10 includes an upper half inner surface 20 and the lower half includes a lower half inner surface 21.

The upper half 10 and the lower half 11 of the glide 1 are constructed of a resilient thermoplastic material such as Nylon 66. The outer surface of the lower portion 18 of the lower half 11 is made relatively smooth to provide a relatively low friction surface while the outer surface of the upper half 10 and the outer surface of the upper portion 19 of the lower half 11 are generally textured to have a rough finish.

The upper half 10 is securable to the lower half 11 generally along an interfacial or equatorial plane to generally form a sphere. A central or vertical axis extends perpendicularly through the interfacial plane of the glide 1 and through the center of the leg receiving aperture 15.

The upper half 10 is securable to the lower half 11 by cooperating interference means such as circumferential wall 23 and recess 24. The circumferential wall 23 may also be referred to as a first or inner lip 23. The inner lip 23 is integrally formed in the lower half 11. The recess 24 is defined by a second or outer lip 25 integrally formed in the upper half 10. The outer lip 25 is continuous and extends circumferentially generally along a lower portion of the upper half 10.

The outer lip 25 includes a downwardly and inwardly directed interference surface 27 and an outer lip outer surface 28. The inwardly directed interference surface 27 is separated from the upper half inner surface 20 by a first or upper shoulder 31. An outer lip inner edge or corner 32, which may be rounded, is formed at an outer end of the inwardly directed interference surface 27. The outer lip inner edge 32 extends between the inwardly directed interference surface 27 and an upper half interfacial surface 33. The upper half interfacial surface 33 is separated from the outer lip outer surface 28 by an upper chamfer 34 angled slightly upward or away from the upper half interfacial surface 33. The outer lip outer surface 28 is generally continuous with the outer surface of the upper half 10 and the outer lip outer surface 28 has a radius of curvature that is generally equal to the radius of curvature of the outer surface of the upper half 10.

The inner lip 23 is generally continuous and frusto-conical and extends circumferentially above or beyond a lower shoulder or lower half interfacial edge 39 of the lower half 11. The inner lip 23 includes an upwardly and outwardly directed interference surface 42 and an inner lip inner surface 43. An inner lip upper surface 46 extends between the outwardly directed interference surface 42 and the inner lip inner surface 43. The intersection of the inner lip upper surface 46 and the outwardly directed interference surface 42 is rounded to form a radius 48. The lower half interfacial surface 39 extends from the base of the outwardly directed interference surface 42 to a lower chamfer 50 which is angled downward and which extends to the outer surface of the lower half 11.

The inner lip inner surface 43 intersects the lower half inner surface 21 just below the lower half interfacial surface 39. The inner lip inner surface 43 from its intersection with the lower half inner surface 21 to the inner lip upper surface 46 is angled approximately five degrees away from the central axis of the glide 1. The outwardly directed interference surface 42 from the lower half interfacial surface 39 to the inner lip upper surface 46 is angled approximately seven degrees away from the central axis of the glide 1. The inwardly directed interference surface 27 from the upper shoulder 31 to the upper half interfacial surface 33 is angled approximately seven degrees towards the central axis of the glide 1.

The diameter of outer lip 25 along the outer lip inner edge 32 approximately equals the diameter of the inner lip 23 along the intersection of the outwardly directed interference surface 42 and the lower half interfacial surface 39. The diameter of the inner lip 23 generally along the intersection of the outwardly directed interference surface 42 and the radius 48 is slightly greater than the diameter of the outer lip 25 along the outer lip inner edge or corner 32.

After the upper half 10 and lower half 11 are formed, preferably by molding, the upper half 10 and lower half 11 are fastened or secured together through the interlocking of the outer lip 25 and the inner lip 23. In particular, the upper half 10 is positioned on top of or over the lower half 11 whereupon the outer lip inner edge 32 of the outer lip 25 circumferentially engages the radius 48 of the inner lip 23. The upper half 10 and the lower half 11 are urged towards one another whereupon the outer lip inner edge 32 compresses or biasingly urges the inner lip 23 inward and the radius 48 expands or biasingly urges the outer lip 25 outward. The compression of the inner lip 23 and the expansion of the outer lip 25 allows the outer lip inner edge 32 to advance past the radius 48 whereupon the upper half interfacial surface 33 is advanced into abutting relationship with the lower half interfacial surface 39 and the interfacial plane extends therebetween. As the upper half interfacial surface 33 is advanced into abutting relationship with the lower half interfacial surface 39, the inherent resiliency of the inner lip 23 urges the inner lip 23 outward and the inherent resiliency of the outer lip 25 urges the outer lip 25 inward whereupon the outwardly directed interference surface 42 of the inner lip 23 abuttingly engages the inwardly directed interference surface 27 of the outer lip 25 to form an interference fit. The interference fit resists separation of the upper half 10 from the lower half 11;.

A cylindrical nipple or post 60 is integrally formed with the lower half 11 of the glide 1 on the lower half inner surface 21. The nipple 60 is preferably hollow and is centrally formed in the lower half 11. When the upper half 10 is secured to the lower half 11, the nipple 60 is centrally aligned with the central axis of the glide 1 and the leg receiving aperture 15. Four elongate bosses 61 are formed on an outer surface of the nipple 60 in radial spaced alignment and extend lengthwise with respect to the nipple 60. The diameter of the nipple 60 is slightly smaller than the diameter of the hollow interior or cavity 5 of the leg 2 to which the glide 1 is to be attached. The diameter of a circle formed by connecting the outer edges of the elongate bosses 61 is slightly greater than the diameter of the cavity 5 of the leg 2.

Four lower half ribs 70 are integrally formed with the lower half 11 to extend inward from the lower half inner surface 21 from the lower portion 18 of the lower half 11 upward toward the inner lip inner surface 43. The lower half ribs 70 are circumferentially spaced about the lower half inner surface 21. The diameter of a circle formed by connecting the inner edge of the lower half ribs 70 is preferably slightly greater than the outer diameter of the leg 2 to which the glide 1 is to be attached.

Four upper half ribs 75 are integrally formed with the upper half 10 and extend inward from the upper half inner surface 20. The upper half ribs 75 generally extend from a position adjacent the leg receiving aperture 15 to the upper shoulder 31. The upper half ribs 75 are radially spaced around the upper half inner surface 20. The diameter of a circle formed by connecting the inner edges of the upper half ribs 75 adjacent the leg receiving aperture 15 is approximately equal to the diameter of the leg receiving aperture 15 and therefore slightly larger than the outer diameter of a leg 2 to which the glide 1 is to be attached. However, the inner edges of the upper half ribs 75 are angled slightly inward and the diameter of a circle formed by connecting the inner edges of the upper half ribs 75 at an end of the ribs 75 closest the upper shoulder 31 is slightly smaller than the diameter of a leg 2 to which the glide 1 is to be attached.

As discussed above the upper half 10 and the lower half 11 of the glide 1 are secured together before the glide is attached to the leg 2 of a chair 3. The leg receiving aperture 15 of the glide 1 is aligned with the leg 2 and the glide 1 is then advanced toward the leg 2 whereupon the leg 2 extends into the leg receiving aperture 15. The upper half ribs 75 abuttingly engage the leg 2 but allow the leg 2 to slidingly pass therebetween.

As the leg 2 advances into the glide 1, a bottom circular edge 80 of the leg 2 engage the elongate bosses 61. Additional force, such as the force applied by a rubber mallet, generally must be applied to the glide 1 to urge the nipple 60 into the cavity 5 of the leg 2 against the interference of the elongate bosses 61. As the nipple 60 is urged into the hollow interior or cavity 5, the bottom circular edge 80 of the leg 2 tends to scrape away a portion of the elongate bosses 61. The nipple 60 is also slightly resiliently compressed as the nipple 60 is urged into the hollow interior or cavity 5 of the leg 2. The inherent resiliency of the nipple 60 biases the nipple outward against the compressive force of the leg 2 to secure the glide 1 to the leg by a compression fit between the leg 2 and the nipple 60.

It is to be understood that while certain forms of the present invention have been illustrated and described herein, it is not to be limited to the specific forms or arrangement of parts described and shown.

What is claimed and desired to be secured by Letters Patent is as follows:

1. In a glide for a structural leg comprising a first portion, a second portion and means for securing said glide to said leg, the improvement comprising:
   (a) cooperating interference means on said first portion and said second portion for interferingly securing said first portion to said second portion.

2. The improved glide as disclosed in claim 1 wherein said cooperating interference means comprises:
   (a) a first lip on said first portion; and
   (b) a second lip on said second portion; said first lip interferingly engaging said second lip so as to secure said first portion to said second portion.

3. The improved glide as disclosed in claim 2 wherein said first lip and said second lip are continuous.

4. The improved glide as disclosed in claim 2 wherein said glide is made of a resilient material.

5. A substantially spherical endpiece for attachment to an end of a cylindrical tube comprising:
   (a) a first half being substantially frustohemispherical and having a tube receiving aperture extending therethrough;
   (b) a second half being substantially hemispherical;
   (c) a circumferential wall secured to and extending beyond an interfacial surface of one of said first half and said second half;
   (d) the other of said first half and said second half including a recess adapted to engage said circumferential wall to secure said first half to said second half; and
   (e) means for securing said endpiece to said tube when said tube is positioned within said tube receiving aperture.

6. The spherical endpiece as disclosed in claim 5 wherein:
   (a) an outwardly directed interference surface of said circumferential wall is angled slightly away from a central axis of said spherical endpiece from a base of said circumferential wall to an upper surface of said circumferential wall; and
   (b) an inwardly directed interference surface which cooperates with a first shoulder to define said recess is angled slightly toward the central axis of said spherical endpiece from said first shoulder to an outer end of said inwardly directed interference surface whereupon said inwardly directed interference surface is adapted to engage said outwardly directed interference surface when said first half is secured to said second half.

7. The spherical endpiece as disclosed in claim 6 wherein:
   (a) an inner surface of said circumferential wall is angled slightly away from the central axis of said spherical endpiece.

8. The spherical endpiece as disclosed in claim 5 wherein said spherical endpiece is substantially hollow and said means for securing said endpiece to said tube comprises:

(a) a nipple extending from an inner surface of said second half toward said first half in axial alignment with said tube receiving aperture; said nipple receivable within a cylindrical cavity in the cylindrical tube for securing the spherical endpiece thereto.

9. The spherical endpiece as disclosed in claim 8 further comprising:

(a) a plurality of elongate bosses extending radially outward from said nipple; said bosses adapted to engage an inner surface of the cylindrical tube to secure said spherical endpiece to the cylindrical tube.

10. The spherical endpiece as disclosed in claim 5 wherein the spherical endpiece is substantially hollow and said endpiece further comprises:

(a) a plurality of support ribs integrally formed on an inner surface of said first half and on an inner surface of said second half of said endpiece.

11. The glide as disclosed in claim 5 wherein said glide is made of a resilient material.

12. A substantially spherical glide adapted to be secured to a length of tubing forming a leg of a piece of furniture; said tubing defining a cavity; said glide comprising:

(a) an upper half being substantially frustohemispherical and having a leg receiving aperture extending therethrough;

(b) a lower half being substantially hemispherical;

(c) an outer lip integrally formed with and extending circumferentially below said upper half;

(d) an inner lip integrally formed with and extending circumferentially above said lower half; said outer lip adapted to interferingly engage said inner lip to secure said upper half to said lower half;

(e) a nipple extending upward from a lower portion of said lower half; said nipple receivable within the cavity of the tubing forming the leg;

(f) a plurality of elongate bosses extending radially outward from said nipple; said bosses adapted to engage an inner surface of the tubing so as to secure said glide to the tubing when the tubing is extended through the leg receiving aperture; and (g) a plurality of support ribs integrally formed on an inner surface of said upper half and on an inner surface of said lower half of said glide.

13. The spherical glide as disclosed in claim 12 wherein:

(a) said lower portion of said lower half has a greater radius of curvature than an upper portion of said lower half whereupon said lower portion is generally flattened.

14. The spherical glide as disclosed in claim 13 wherein:

(a) an outer surface of said lower half at said lower portion is relatively smooth as compared to said outer surface of said lower half at said upper portion.

15. The spherical endpiece as disclosed in claim 12 wherein:

(a) an outwardly directed interference surface of said inner lip is angled slightly away from a central axis of said spherical endpiece from a base of said inner lip to an upper surface of said inner lip; and (b) an inwardly directed interference surface of said outer lip is angled slightly towards the central axis of said spherical endpiece from a base of said outer lip to an outer end of said inwardly directed interference surface whereupon said inwardly directed interference surface is adapted to engage said outwardly directed interference surface when said first half is secured to said second half to interferingly resist separation of said first half from said second half.

16. The spherical endpiece as disclosed in claim 15 wherein:

(a) an inner surface of said inner lip is angled slightly away from the central axis of said spherical endpiece.

17. The glide as disclosed in claim 12 wherein said glide is made of a resilient material.

* * * * *